US010455988B2

(12) United States Patent
Lyons et al.

(10) Patent No.: US 10,455,988 B2
(45) Date of Patent: Oct. 29, 2019

(54) MAGNETIZED ACCESSORY SYSTEM FOR BATH OR SHOWER WALLS

(71) Applicant: AS IP HOLDCO, LLC, Piscataway, NJ (US)

(72) Inventors: Alison J. Lyons, Morristown, NJ (US); Charles A. Patterson, Durango, CO (US); Christophe Bucher, Hillsborough, NJ (US); Daigo Ishiyama, Summit, NJ (US); Ronald D. Barndt, Bethlehem, PA (US); Jean-Jacques L'Henaff, New Canaan, CT (US)

(73) Assignee: AS AMERICA, INC., Piscataway, NJ (US)

( * ) Notice: Subject to any disclaimer, the term of this patent is extended or adjusted under 35 U.S.C. 154(b) by 15 days.

(21) Appl. No.: 15/652,743

(22) Filed: Jul. 18, 2017

(65) Prior Publication Data

US 2018/0020879 A1 Jan. 25, 2018

Related U.S. Application Data

(60) Provisional application No. 62/364,186, filed on Jul. 19, 2016.

(51) Int. Cl.
*A47K 3/28* (2006.01)
*A47K 3/00* (2006.01)

(52) U.S. Cl.
CPC ..... *A47K 3/281* (2013.01); *A47K 3/001* (2013.01)

(58) Field of Classification Search
CPC ..... A47K 3/281
USPC ..... 4/614, 559; 248/206.5, 309.4
See application file for complete search history.

(56) References Cited

U.S. PATENT DOCUMENTS

2005/0116392 A1* 6/2005 Vesci ..... H01F 7/0221 264/611
2010/0148896 A1* 6/2010 Hugo ..... H01F 7/0252 335/285
2015/0366409 A1* 12/2015 Cohen ..... A47B 5/04 4/611

* cited by examiner

*Primary Examiner* — Lauren A Crane
(74) *Attorney, Agent, or Firm* — Morgan, Lewis & Bockius LLP

(57) ABSTRACT

A bath or shower storage system which offers customizable storage solutions for a bath or shower. The bath or shower storage system includes a bath or shower wall having a magnet-friendly zone formed by an integrated panel within the bath or shower wall, and one or more magnetic shelves which can be attached to the magnet-friendly zone. The magnetic shelves include an attachment member that includes one or more magnets, and a storage member to store bath products. The bath or shower storage system may include a variety of storage solutions such as shallow trays, shelves, washcloth holders, and hooks.

17 Claims, 3 Drawing Sheets

MAGNETIZED ACCESSORY SYSTEM FOR BATH OR SHOWER WALLS

CROSS-REFERENCE TO RELATED APPLICATIONS

This application claims the benefit of U.S. Provisional Patent Application No. 62/364,186, filed Jul. 19, 2016, which is incorporated herein by reference in its entirety.

TECHNICAL FIELD

The present invention relates generally to bath or shower walls that include customizable storage shelves and accessories that may be integrated with the shower or bath wall.

BACKGROUND

The majority of bath or shower walls include integrated formed shelves for storage of bottles, washcloths, bathing and shaving accessories, etc. These shelves are located in fixed locations in the bath or shower wall. One drawback of this design is that users are not able to customize the number, location, or type of shelves within the bath or shower for their particular needs. For instance, large households where a number of people must share a bath or shower may require more shelving to accommodate each person's bath products. Users who are particularly tall or short, the elderly, or individuals with disabilities may desire shelving at a particular height. Users who utilize products in their bath like washcloths, loofahs, toothbrushes, or shaving products may desire shelving that is particularly customized to the shapes of these products.

An alternative approach to these traditional integrated shelves is after-market shelving that may be attached to the bath or shower wall surface via a suction cup or tension rod, or alternatively hung from a shower head, shower door handle, or shower rod. These after-market shelves also face drawbacks. Suction cups are often not sturdy enough to support heavier bottles or products, and may slide along a bath or shower wall in wet and soapy conditions. Both suction cup and shower rod attachments also may create areas within the bath or shower that are difficult to clean and can become grimy. Hanging shelves also do not provide a stable storage surface for heavy products, and may become imbalanced when products of varied loads are stored on the same shelf These after-market shelves also are generally not formed of the same material, color, or pattern of the bath or shower wall, and therefore are not aesthetically pleasing when placed within the bath or shower.

There is therefore a need in the art for an effective bath or shower wall storage shelf that provides the advantages of integrated shelving of sturdiness and cleanliness and the customization advantages of after-market products, to provide better modes of bath and shower storage and allow the user to decide how many storage accessories he/she needs and the optimal positions for the storage.

BRIEF SUMMARY OF THE INVENTION

A system is disclosed for bath or shower storage that comprises a wall located on one or more sides of the bath or shower, wherein the wall includes an exterior surface that faces the bath or shower and an interior surface that faces away from the bath or shower; a panel comprising magnet-attracting material, wherein the panel is located on the interior surface of the wall so that it creates a magnet-attracting zone in the wall; and one or more magnetic accessories comprising an attachment member and a storage member, wherein the attachment member comprises one or more magnets.

In one aspect, the panel may be attached to the interior surface of the wall. The wall may include a shallow pocket, and the panel may be located within the shallow pocket. In another aspect, the panel may comprise steel. In another aspect, the magnetic accessory may be formed of injection-molded plastic. In one aspect of the present invention, the attachment member may be substantially perpendicular to the storage member. In another aspect, the one or more magnets are located in a recessed portion of the attachment member. In another aspect, the magnets may have a pull force of 150-250 lbs. In another aspect, the storage member includes grooves on a first surface of the storage member. In another aspect, the storage member includes a vertical barrier surrounding one or more free edges of the storage member to form a tray. In another aspect, the storage member comprises a shelf. In another aspect, the storage member comprises at least one of a rod and a hook. In another aspect, the system includes a cover panel that attaches to the attachment member so that the magnet is not exposed. In another aspect, the magnet is coated with a water resistant material. In another aspect, the magnetic shelf is formed of injection-molded plastic.

In another aspect of the invention, the wall is integrated with the bath or shower, and comprises an exterior surface that faces the bath or shower and an interior surface that faces away from the bath or shower, wherein a panel comprising magnet-attracting material is attached to the interior side of the wall so that it creates a magnet-attracting zone in the wall. In another aspect, the wall comprises thermoformed acrylic or HIPS (High Impact Polystyrene), and the panel comprises steel.

In another aspect of the invention, a method for using the system is disclosed, comprising selecting a placement of the attachment member against the wall in the magnetic-attracting zone of the wall so that the one or more magnets are facing the wall and the storage member protrudes outwardly from the wall; and attaching the magnetic shelf to the wall in the magnetic-attracting zone of the wall.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The foregoing and other objects, features and advantages of the present invention, as well as the invention itself, will be more fully understood from the following description of preferred embodiments, when read together with the accompanying drawings, in which.

DETAILED DESCRIPTION OF THE INVENTION

A bath or shower wall system may be provided that allows for user-determined positioning of magnetized shower accessories, rather than predetermined accessory locations in bath or shower wall surrounds. The users can determine the best locations for the accessories to afford a more ergonomic bathing or showering experience depending upon, for example, the individual height and reach of the user. The system has a variety of storage solutions including shelves, shallow trays, hooks and washcloth holders, for example.

Figure 1:
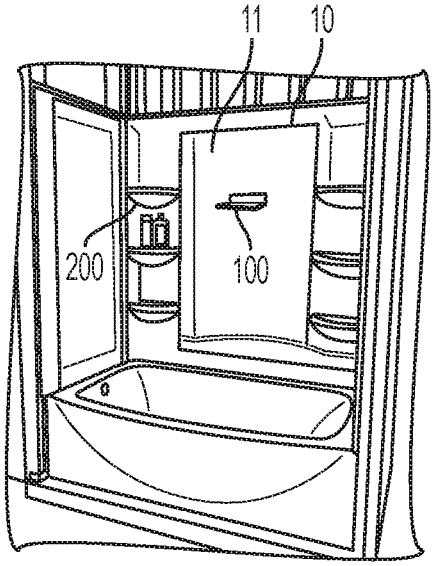
FIG. 1 shows a front view of a bath or shower wall having an embodiment of the integrated magnetic shelving installed.
Figure 2:
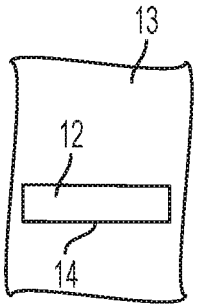
FIG. 2 shows a rear view of the bath or shower wall with an embodiment of the interior panel installed.

With reference to FIGS. 1 and 2, a bath or shower wall storage system according to some embodiments of the present invention includes a magnetic accessory, including, a magnetic shelf 100 that can be placed in a customized location on a bath or shower wall 10. In the illustrated embodiments, the wall 10 may include a panel formed of magnet-attracting material such as an integrated panel 12 as shown that is formed of magnet-attracting material to secure magnetic shelf 100. The integrated panel 12 on the interior-facing wall side allows for user-determined positioning and repositioning of magnetized shower accessories on the exterior or shower-user side, as discussed more below.

A typical bath or shower includes at least one wall surface that may include accessories such as shelving for bath product storage. As shown in FIG. 1, a bath or shower wall 10 includes an exterior surface 11 which faces into the bath or shower enclosure. The bath or shower wall 10, for example, may be located above a bathtub or shower base. The bath or shower wall 10 may be made of thermoformed acrylic or HIPS (High Impact Polystyrene), plastic, composite material, ceramic, or tile. In some embodiments, the bath or shower wall 10 is not made from a material that, by itself, is attracted to magnets. In an embodiment, the bath or shower wall 10 may include one or more movable magnetic shelves 100. In an embodiment, the bath or shower wall 10 may also include one or more fixed integrated shelves 200. The fixed integrated shelves 200 may be formed from the same mold as the bath or shower wall 10.

FIG. 2 shows a rear view of the bath or shower wall 10. The bath or shower wall 10 also includes an interior-facing surface 13. The bath or shower walls may be formed to include a shallow pocket 14 in the interior-facing surface 13 for an integrated panel 12 to be affixed into the pocket 14. When placed in the shallow pocket 14, the integrated panel 12 becomes integral to the interior-facing surface 13 of the bath or shower wall 10. The integrated panel 12 and the shallow pocket 14 may be located in any portion of the bath or shower wall 10. The integrated panel 12 may also be shaped to match the shape of the interior-facing surface 13 of the bath or shower wall 10. The integrated panel 12 may be flush with the interior-facing surface 13. Alternatively the interior-facing surface 13 can be a flat surface and the integrated panel 12 may be positioned on the flat surface. The integrated panel 12 may remain exposed and/or visible from the interior side, even if positioned in the shallow pocket. In some embodiments, integrated panel 12 is not visible from the exterior surface 11 of the bath or shower wall 10.

The integrated panel 12 within the shallow pocket 14 creates a magnet-friendly zone on the bath or shower wall 10. The integrated panel 12 may be made of materials that are attracted to magnets, including steel, iron, cobalt, and nickel, which offers reinforcement for the attachment of the accessories. The magnet-friendly zone created by the integrated panel 12 allows for magnetized shelves 100 to be attached anywhere in that zone on the exterior surface 11 of the bath or shower wall 10. In certain embodiments, the exterior surface 11 of the bath or shower wall 10 by itself is not attractive to magnetic fields. The magnetized shelves 100 may be positioned and repositioned as desired to be positioned in a variety of configurations and as the selection and discretion of the user. One aspect of the invention allows for selection of the placement and/or positioning of the magnetized shelves 100 or attachment members against the wall in the magnetic-attracting zone of the wall. The integrated panel 12 is preferably placed in an area of the bath or shower wall 10 that does not include fixed integrated shelves 200, where users may desire additional integrated shelving. It is understood by those in the art that the size, shape, and placement of the integrated panel 12 may vary depending on the size, shape, and configuration of the bath or shower, so as to optimize the placement of magnetic shelves 100 in desired locations within the bath or shower.

Figure 3:
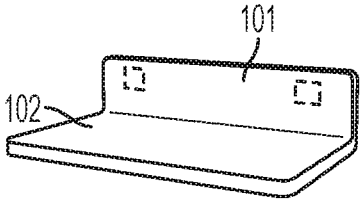
FIG. 3 shows a front perspective view of an embodiment of the integrated magnetic shelving.

As shown in FIG. 3, in an embodiment, the movable magnetic shelves 100 may include an attachment member 101 and a storage member 102. The magnetic shelf 100 may be made of plastic, composite material, ceramic, or metallic materials. Preferably, the magnetic shelf 100 may be formed of an injection molded plastic. The attachment member 101 is preferably placed flush with exterior surface 11 of the bath or shower wall 10, so that it is parallel to the exterior surface 11. The attachment member 101 includes magnetic material so that when the attachment member 101 is placed flush with the exterior surface 11 in the magnet- friendly zone created by integrated panel 12, the magnetic shelf 100 can be attached to the bath or shower wall 10. In some embodiments, magnetic shelf 100 is configured to magnetically couple with integrated panel 12. In some embodiments, the magnetic material of attachment member 101 generates a magnetic field to which the integrated panel 12 is attracted. In some embodiments, the bath or shower wall 10 is sandwiched between the attachment member 101 and the integrated panel 12 when magnetic shelf 100 is positioned on the exterior surface 11. In an embodiment, the storage member 102 of the magnetic shelf 100 is formed approximately perpendicular to the attachment member 101, such that the storage member 102 projects outward from the exterior surface 11 of the bath or shower wall 10 in a perpendicular direction. In some embodiments, the storage member 102 is configured to project away from exterior surface 11 and into the bath or shower enclosure when attachment member 101 is positioned on exterior surface 11.

Figure 4:
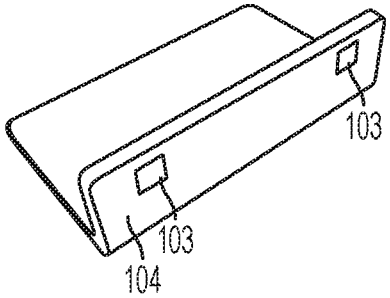
FIG. 4 shows a rear perspective view of an embodiment of the integrated magnetic shelving prior to installation on the bath or shower wall.

FIG. 4 shows a rear view of the movable magnetic shelf 100 according to an embodiment, which shows several magnets 103 located on the rear surface 104 of the attachment member 101. While FIG. 4 illustrates two magnets 103 positioned at different ends of rear surface 104, it should be appreciated that attachment member 101 could include fewer or more magnets 103 according to other embodiments. For example, attachment member 101 could have a single magnet 103 which may be, in one embodiment, centrally positioned on rear surface 104. In alternative embodiments, attachment member 101 may include three or more magnets 103 arranged at different locations on rear surface 104. The magnets 103 are preferably placed in a recessed portion of attachment member 101. In some embodiments, magnets 103 may be flush with rear surface 104. It is understood by those in the art that the magnets 103 may be formed of any permanent magnet materials, including rare-earth magnets, Neodymium Iron Boron (NdFeB or NIB), Samarium Cobalt (SmCo), Alnico, Ceramic, or Ferrite. In an embodiment, the magnets 103 are coated with a water-resistant material to prevent rust or corrosion. The magnets 103 may be of a sufficient strength such that the magnetic shelf 100 can be removed from the bath or shower wall 10 for easy cleaning, while also supporting forces from storage loads placed on the storage member 102. In some embodiments, magnetic shelf 100 may be removed from the bath or shower wall 10 by pulling magnetic shelf 100 away from exterior surface 11 with sufficient force to overcome the magnetic force of magnets 103. In some embodiments, magnetic shelf 100 may be removed from the bath or shower wall 10 by sliding magnetic shelf 100 along exterior surface 11 to a location away from the magnet-friendly zone created by the integrated panel 12. In an embodiment, the magnets 103 may have a combined pull force of 150-250 lbs. In an embodiment, magnets 103 with a combined pull force greater than 180 lbs. are used to support approximately 6-6.5 lbs. of load on the storage member 102.

Figure 5A:
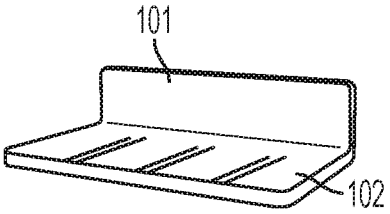
FIGS. 5A-5D show other forms of shelving and storage components which may be used in an embodiment of the integrated magnetic shelving.
Figure 5B:
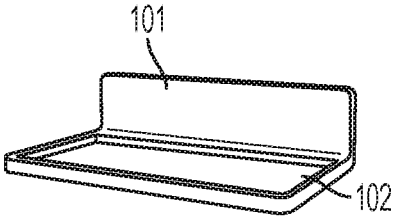
Figure 5C:
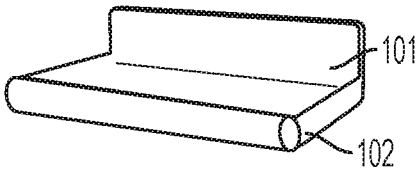
Figure 5D:
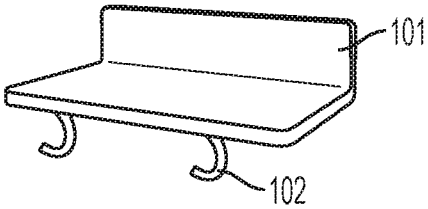

In an embodiment, a plurality of magnetic shelves 100 may be attached to a single bath or shower wall 10. The magnetic shelves 100 may have a number of different sizes, shapes, and configurations to store various bath products. For instance, FIG. 5A shows an embodiment of magnetic shelf 100 that includes one or more grooves on the storage member 102 in order to store a bar of soap, a sponge, or other products that require air-drying on all surfaces. FIG. 5B shows an embodiment of magnetic shelf 100 that includes a storage member 102 that is a shallow tray to store smaller items that may roll or slip off a shelf. The tray may include, for example, a vertical barrier surrounding one or more free edges of the storage member 102 that is configured to help retain items on the storage member 102. FIG. 5C shows an embodiment of magnetic shelf 100 that includes a storage member 102 having a rod, for example, to hang a washcloth. FIG. 5D shows an embodiment of magnetic shelf 100 that includes a storage member 102 that has one or more hooks to hang smaller items like razors, toothbrushes, and loofahs. In some embodiments, magnetic shelf 100 may be configured to allow water to drain from storage member 102. For example, storage member 102 may include one or more drainage holes or pathways configured to direct water off of storage member 102. It is understood by those in the art that the size and shape of the magnetic shelf 100 may be modified to accommodate specific types and sizes of bath products.

In an embodiment, a user who purchases the bath or shower wall system may be provided with a kit of magnetic shelves 100 of varying sizes and designs in order to customize the user's bath or shower storage. In an embodiment, additional accessories may be offered to extend the system and accommodate larger families or those with greater or particular storage needs.

Figure 6A:
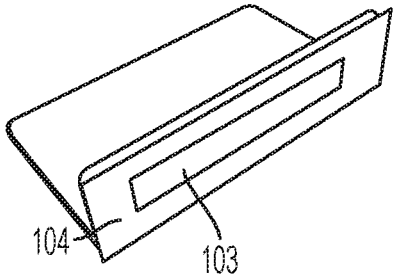
FIGS. 6A-6D show rear perspective views of additional embodiments of the integrated magnetic shelving.
Figure 6B:
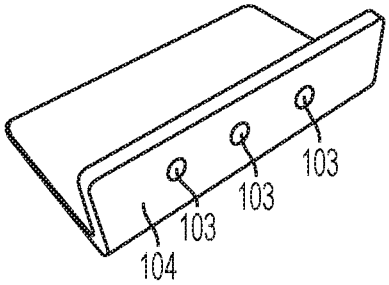
Figure 6C:
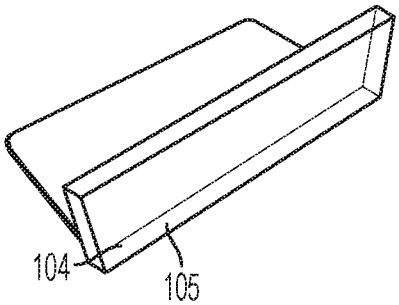
Figure 6D:
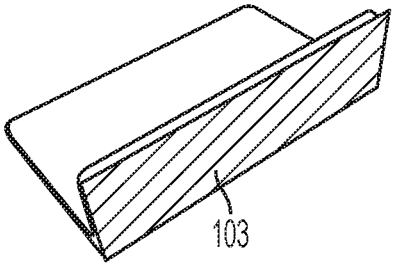

In an embodiment, the attachment member 101 may include a single magnet 103, as shown in FIG. 6A. In another embodiment, the attachment member 101 may include three or more circular magnets placed in a linear fashion along the surface of attachment member 101, as shown in FIG. 6B. The size or number of magnets may vary, depending on the size of storage member 102, or the size or weight of items to be stored on the storage member 102. In another embodiment, a cover panel 105 made of the same material as the magnetic shelf 100 may be placed on the attachment member 101 to cover the magnets 103 in an aesthetically pleasing manner, as shown in FIG. 6C. The cover panel may also be sealed to the attachment member so as to protect from water entering the recessed portion where the magnets 103 are located. In another embodiment, the attachment member 101 may be formed of a magnetic material, as shown in FIG. 6D. It is understood by those in the art that the number and placement of the magnets 103 may vary depending on the size, shape, and expected load of the magnetic shelf 100, as well as the strength of the magnets 103.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A system for bath or shower storage, comprising:

a wall located on one or more sides of the bath or shower, wherein the wall includes an exterior surface that faces the bath or shower and an interior surface that faces away from the bath or shower, the interior surface having a pocket;

a panel comprising magnet- attracting material, wherein the panel is located within the pocket of the interior surface of the wall so that it creates a magnet-attracting zone in the wall;

one or more magnetic accessories comprising an attachment member and a storage member, wherein the attachment member comprises one or more magnets.

2. The system of claim 1, wherein the panel is attached to the interior surface of the wall.

3. The system of claim 1, wherein the panel is flush with the interior surface.

4. The system of claim 1, wherein the panel comprises steel.

5. The system of claim 1, wherein the magnetic accessory is formed of injection-molded plastic.

6. The system of claim 1, wherein the attachment member is substantially perpendicular to the storage member.

7. The system of claim 1, wherein the one or more magnets are located in a recessed portion of the attachment member.

8. The system of claim 1, wherein the one or more magnets have a pull force of 150-250 lbs.

9. The system of claim 6, wherein the storage member includes grooves on a first surface of the storage member.

10. The system of claim 6, wherein the storage member includes a vertical barrier surrounding one or more free edges of the storage member to form a tray.

11. The system of claim 1, wherein the storage member comprises a shelf.

12. The system of claim 1, wherein the storage member comprises at least one of a rod and a hook.

13. The system of claim 7, the system further comprising a cover panel that attaches to the attachment member so that the one or more magnets are not exposed.

14. The system of claim 1, wherein the one or more magnets are coated with a water resistant material.

15. A wall for a bath or shower, wherein the wall is integrated with the bath or shower, comprising:

an exterior surface that faces the bath or shower and an interior surface that faces away from the bath or shower, the interior surface having a pocket, wherein a panel comprising magnet-attracting material is located within the pocket and attached to the interior surface of the wall so that it creates a magnet- attracting zone in the wall.

16. The wall of claim 15, wherein the wall comprises thermoformed acrylic or HIPS (High Impact Polystyrene), and further wherein the panel comprises steel.

17. A method of using the system of claim 1, comprising:

selecting a placement of the attachment member against the wall in the magnet- attracting zone of the wall so that the one or more magnets are facing the wall and the storage member protrudes outwardly from the wall;

attaching the one or more magnetic accessories to the wall in the magnetic-attracting zone of the wall.

* * * * *